US006606764B2

(12) United States Patent
Taubner, III et al.

(10) Patent No.: US 6,606,764 B2
(45) Date of Patent: Aug. 19, 2003

(54) BEADED CHAIN CONNECTOR

(75) Inventors: Valentine J. Taubner, III, Pelham Manor, NY (US); James P. Taubner, Pelham Manor, NY (US)

(73) Assignee: Ball Chain Manufacturing Co., Inc., Mt Vernon, NY (US)

( * ) Notice: Subject to any disclaimer, the term of this patent is extended or adjusted under 35 U.S.C. 154(b) by 0 days.

(21) Appl. No.: 09/879,656

(22) Filed: Jun. 12, 2001

(65) Prior Publication Data

US 2002/0184739 A1 Dec. 12, 2002

(51) Int. Cl.[7] ..... F16G 15/00
(52) U.S. Cl. ..... 24/116 A; 24/115 F; 24/602
(58) Field of Search ..... 24/115 F, 602, 24/116 A; 119/776, 865; 280/822; 59/93; 174/138 B

(56) References Cited

U.S. PATENT DOCUMENTS 1,103,760 A * 7/1914 Goodridge
1,769,245 A * 7/1930 Tregoning
2,857,454 A * 10/1958 Bahr
4,044,725 A 8/1977 Miller
4,180,016 A 12/1979 George
4,192,044 A 3/1980 Ballerini
4,233,714 A 11/1980 Panicci
4,480,589 A 11/1984 Schneider
4,881,492 A 11/1989 Jones
4,917,049 A 4/1990 Peterson
4,944,074 A * 7/1990 Bullat et al.
4,960,077 A 10/1990 Lapidus et al.
5,050,538 A 9/1991 Gurski, Jr.
5,408,220 A 4/1995 Brown et al.
5,509,181 A 4/1996 Yuuki et al.
5,542,462 A * 8/1996 Elsenheimer et al.
5,634,244 A 6/1997 Fetsch et al.
5,689,860 A 11/1997 Matoba et al.
5,791,297 A 8/1998 Mudge
5,913,319 A * 6/1999 Tsai
5,987,709 A * 11/1999 Chou

* cited by examiner

*Primary Examiner*—James R. Brittain

(57) ABSTRACT

A beaded type chain connector includes an external shell and an internal cavity to secure beads from beaded type chainss. The connector is made from a resilient material. The application of force to the beads that are secured within the connector results in the release of beads from the internal cavity when the force exceeds a threshold. The connector can be used as part of a safety device.

7 Claims, 3 Drawing Sheets

BEADED CHAIN CONNECTOR

FIELD OF THE INVENTION

The present invention relates to beaded type chains. Particularly, the invention relates to connectors for coupling beaded type chain ends.

BACKGROUND

Beaded type chains are used for a wide variety of applications, from holding keys by a chain, to operating blinds, drapes, and curtains, as well as for retaining identification tags. The beaded type chain is usually secured in a loop configuration. A connector is sometimes employed to couple together two ends of a single beaded type chain segment to form a looped segment. The connector firmly secures the beaded type chain ends so as to provide for sufficient tension resistance during operation of the device to which the beaded type chain is secured. Accordingly, the connector is usually designed to hold the beaded type chain together under high force application. Present metal type connecting attachments cannot be reused after being subject to high force which distorts the connector and breaks it open. Furthermore, if the connector does not distort and breaks open, the bead portions of the beaded chain break open instead. Therefore, there is a need for a beaded type chain loop configuration that is adapted to release under less force, allows the beaded type chain to separate at the connector, and can be re-used.

SUMMARY OF THE INVENTION

The present invention provides a connector for a beaded type chain that is adapted to release the beaded type chain beads in response to the application of a predetermined force to the beaded type chain. The connector is made from a semi-rigid resilient material that deforms in response to the application of force to its surface. Accordingly, the connector bead retaining portion opens up to allow a bead to release from the connector when force exceeding a threshold level is applied to the beaded type chain. The connectors of the present invention are designed to be re-used after releasing the beads, allowing the beaded type chain to be reassembled.

In one embodiment, the connector includes an internal elongated cavity having a cross section larger than the cross section of a bead of the beaded type chain. The internal cavity is adapted to contain at least two beads. The connector also includes an external shell having a cross-section larger than the cross-section of the internal cavity. The external shell is formed from a resilient material. A median opening is formed from the external shell to the internal cavity. The median opening is adapted to receive a bead into the internal cavity. First and second bore openings are formed from the internal cavity to a first longitudinal end and a second longitudinal end of the connector, respectively. First and second channel opening are formed over the first bore opening and the second bore opening, respectively, to receive a cord into the bore opening. The first and second channel openings extend to the median opening. The first channel opening and the second channel opening expand in response to longitudinal force applied to the beaded type chain that is directed to an end of the connector. The expanding of the channel opening allows at least one bead to release from the internal shell when the longitudinal force exceeds a threshold.

In another embodiment the present invention provides a method for securing beaded type chain ends. The method includes providing a connector having an internal cavity and external shell made of resilient material. The connector has longitudinally opposed bore openings and corresponding channel openings, which expand in response to the application of predetermined force to their walls. The method also includes placing a first bead from a first beaded type chain end into the internal cavity of the connector, whereby the corresponding bead cord extends through a first bore opening into the internal shell. Finally, the method includes placing a second bead from a second beaded type chain end into the internal cavity of the connector, whereby the corresponding bead cord extending through a second bore opening into the internal shell. Thus the method provides a coupling where at least one bead is released from the internal cavity in response to the tension of the beaded type chain exceeding a predetermined threshold.

DETAILED DESCRIPTION

Figure 2:
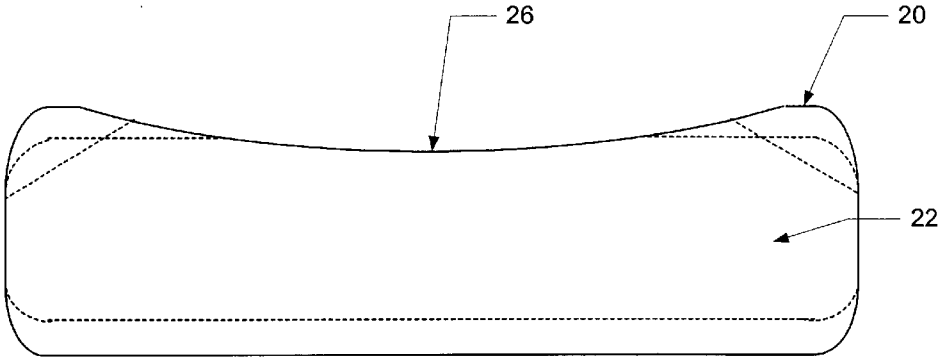
FIG. 2 is a side view of the connector of FIG. 1.
Figure 1:
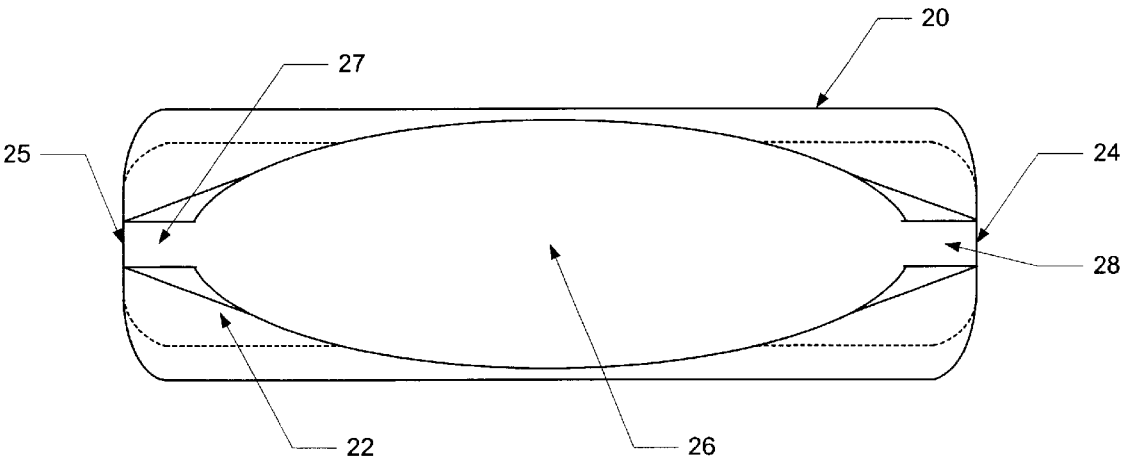
FIG. 1 illustrates the a top view of a connector of the invention.
Figure 3:
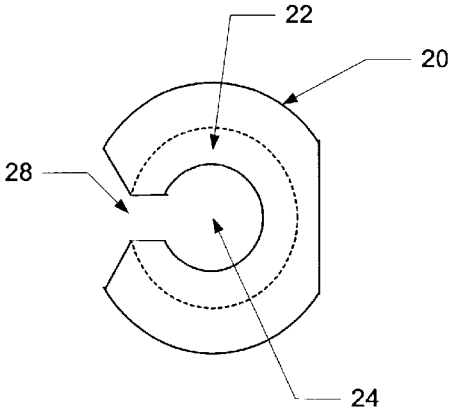
FIG. 3 is a cross-section view of the connector of FIG. 1.

FIGS. 1, 2, and 3 illustrate a connector in accordance with the invention. The connector includes an external shell 20 made from a resilient material. The connector further includes an internal cavity 22 within the external shell 20. The internal cavity 22 is preferably adapted to receive at least two beads of a beaded type chain. The cross-section dimensions of the internal cavity 22 are preferably selected so as to accommodate the beads that the connector is designed to secure.

The connector includes a median opening 26 that extends between the internal cavity 22 and the external shell 20. The median opening 26 is preferably located near the center portion of the connector. The median opening 26 is advantageously larger than the beads it is adapted to receive. Preferably, the median opening 26 is adapted to receive at least one bead. The median opening 26 is integrally coupled to a pair of channel openings 27, 28 at longitudinally opposed ends of the connector. The channel openings 27, 28 extend from the external shell 20 to a pair of bore openings 24, 25 at the corresponding longitudinal ends of the connector.

The connector's external shell 20 is preferably made from a resilient material. The resilient material deforms and bends in response to an application of predetermined force. An application of longitudinal force, directed away from the connector center, results in the removal of beads from the internal shell as a result of deformations in the resilient external shell 20. The resilient material is preferably hard plastic.

Figure 4:
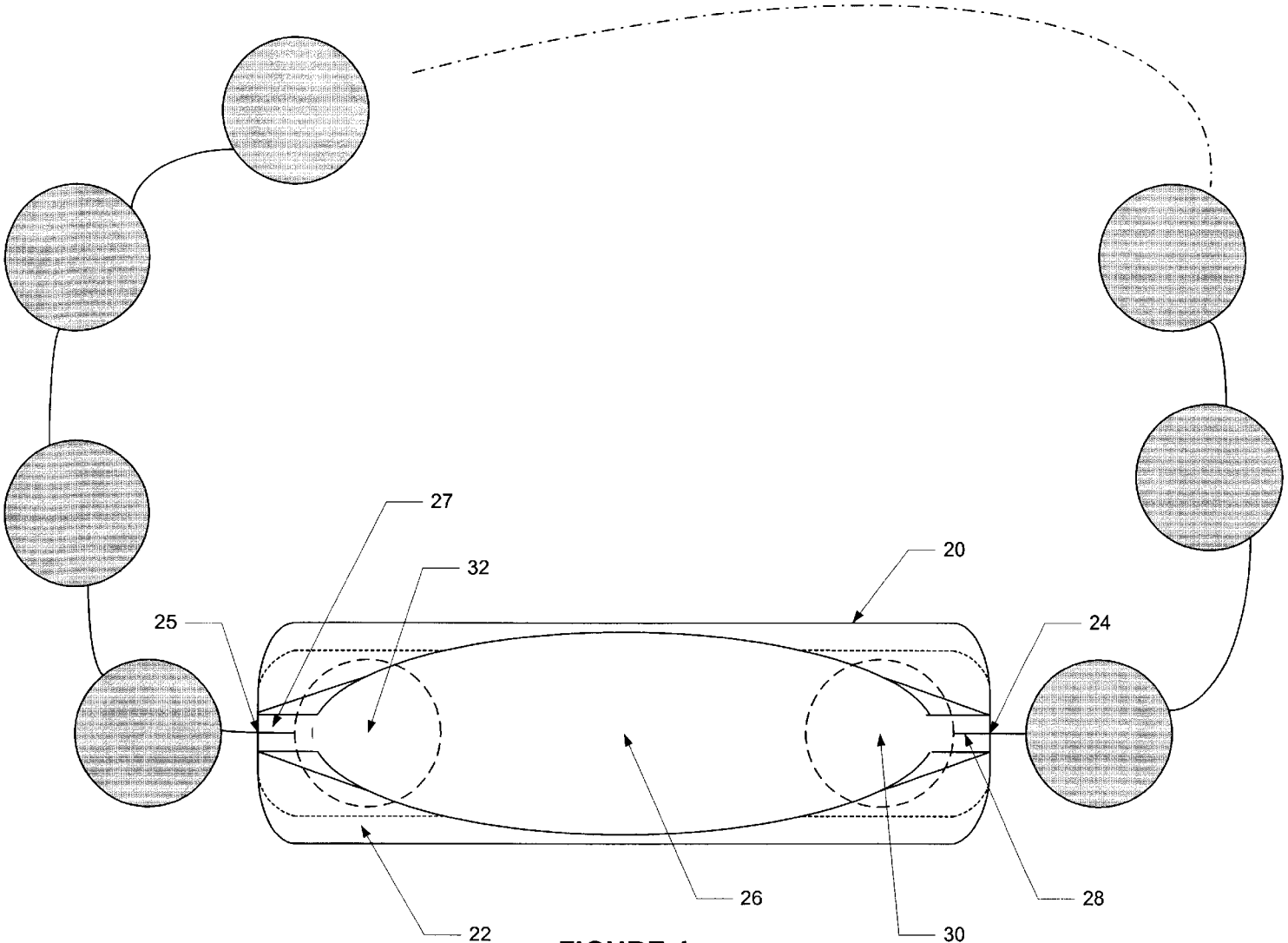
FIG. 4 illustrates the a connector of the invention in a loop configuration with a beaded type chain.

FIG. 4 illustrates a connector of the invention along with a beaded type chain, which forms a closed beaded type chain loop. The connector is adapted to receive at least two beads from the chain into an internal cavity. In operation, chain ends are placed within the connector by way of the median opening 26 and channel openings 27, 28. A first end bead 32 is placed within the internal cavity 22 through the median opening 26. The cord connecting the end bead 32 to the adjacent bead is seated in a first bore opening 25 through a first channel opening 27. A second end bead 30 is placed within the internal cavity 22 through the median opening 26. The cord connecting the end bead 30 to the adjacent bead is seated in a second bore opening 24 through a second channel opening 28. Accordingly, at least two bead of a beaded type chain are secured inside the connector to allow for the transfer of force from a first end portion of a beaded type chain to a second end portion of a beaded type chain. In the loop configuration the first and second end portions are from the same beaded type chain. However, as may be appreciated, in other utilizations of the connector, the end portions belong to different beaded type chains.

The diameter of the bore openings 24, 25 is preferably smaller than the outer diameter of the beads. The beads are preferably maintained in place by force applied longitudinally toward the connector ends, seating the beads away from the median opening 26.

Figure 5:
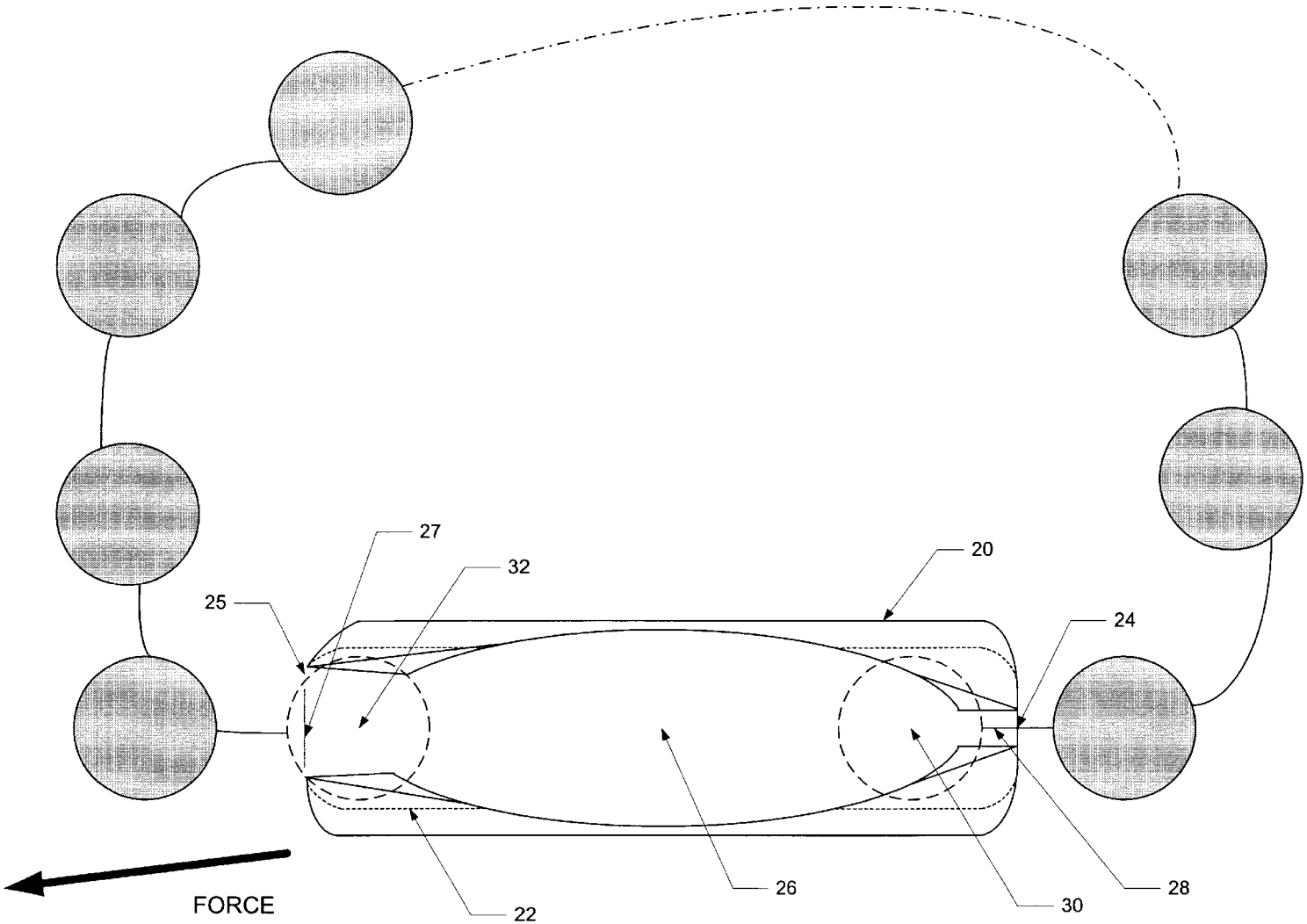
FIG. 5 illustrates the loop configuration of FIG. 4 when force is applied to the beaded type chain.

FIG. 5 illustrates the closed loop beaded type chain configuration of FIG. 4 when force is applied to the beaded type chain loop. The force is transferred, by way of the beaded type chain cord, to the first end bead 32, which is seated in the internal cavity 22. The end bead's external surface transfers the applied force to the external shell's surface portions that are in contact with the bead 32. This surface includes the portions of the bore opening 25 and the channel opening 27 near the bead 32. The connector shell is preferably thinner around these portions. Since the external shell 20 is made from a resilient material, the bore opening 25 expands as a result of the force applied to the bore opening and to the channel opening 27. As the force increases, the bore opening 25 expands further. Eventually, the force exceeds a predetermined level, which causes the bore opening 25 to provide an opening that is greater than the diameter of the secured bead 32. At this time, the bead 32 is released from the connector. The cord potion that is seated in the bore opening 25 is also released from the connector. Accordingly, an application of longitudinal force to the beaded type chain loop results in the distortion of the connector and in turn the release of at least one bead from the connector's internal cavity 22.

The level of force required to release a bead from the internal cavity is preferably controlled by three factors. First, the type of resilient material that is used to construct the connector affects the flexion of the channel opening. Different materials have different resilient properties, thus allowing to vary the flexibility of the shell. Second, the thickness of the external shell is controlled to vary the flexibility of the channel opening and bore opening. The thicker the external shell, the less flexible, and more force resistant, the channel opening. Third, the shape of the channel opening, the bore opening, and the median opening is used to control the flexion point of the connector and accordingly vary the level of force required to release a bead from the connector. The factors are preferably set in accordance with the applicable use for the beaded type chain. For example, beaded type chains in industrial use generally require higher threshold settings for releasing beads from the connector than those for household use.

Although the present invention was discussed in terms of certain preferred embodiments, the invention is not limited to such embodiments. Rather, the invention includes other embodiments including those apparent to a person of ordinary skill in the art. Thus, the scope of the invention should not be limited by the preceding description but should be ascertained by reference to the claims that follow.

What is claimed is:

1. A connector for connecting beaded type chain ends, the chain having a plurality of beads coupled together by cord, comprising:

an internal elongated cavity having a cross section larger than the cross section of a bead of the beaded type chain, the internal cavity adapted to contain at least two beads;

an external shell having a cross-section larger than the cross-section of the internal cavity, the external shell formed from a resilient material;

a median opening formed from the external shell to the internal cavity, the median opening adapted to receive at least one bead into the internal cavity;

a first bore opening formed from the internal cavity to a first longitudinal end of the connector, the bore opening having a cross-section larger than the diameter of the cord;

a first channel opening formed over the first bore opening to receive a cord into the bore opening, the first channel opening extending to the median opening, the first channel opening width linearly decreasing as it extends inward to the first bore opening to provide a tapered first channel opening;

a second bore opening formed from the internal cavity to a second longitudinal end of the connector, the bore opening having a cross-section larger than the diameter of the cord; and a second channel opening formed over the second bore opening to receive a cord into the bore opening, the second channel opening extending to the median opening, the second channel opening width linearly decreasing as it extends inward to the second bore opening to provide a tapered second channel opening, whereby the first channel opening or the second channel opening expand in response to longitudinal force applied to the beaded type chain that is directed to an end of the connector, the expanding of the first or second channel openings allowing a bead to release from the internal shell when the longitudinal force exceeds a threshold.

2. The connector of claim 1, wherein the resilient material is plastic.

3. The connector of claim 2, wherein the plastic is hard plastic.

4. The connector of claim 1, wherein the external shell has a circular shaped cross-section.

5. The connector of claim 1, wherein the external shell has a substantially rectangular shaped cross section.

6. The connector of claim 1, wherein the beaded type chain beads are metallic beads.

7. A method for securing beaded type chain ends in a releasable connection, the beaded type chain having beads secured together by cord portions, comprising:

providing a connector having an internal cavity and external shell made of resilient material, the connector having longitudinally opposed bore openings and corresponding channel openings, the channel openings having a width that linearly decreases as it extends inward to the bore openings to provide tapered channel openings, the channel openings expanding in response to the application of predetermined force to the walls of the channel opening;

placing a first bead from a first beaded type chain end into the internal cavity of the connector, the corresponding bead cord extending through a first bore opening into the internal shell; and placing a second bead from a second beaded type chain end into the internal cavity of the connector, the corresponding bead cord extending through a second bore opening into the internal shell, whereby at least one bead is released from the internal cavity in response to the tension of the beaded type chain exceeding a predetermined threshold.

* * * * *